US010959581B2

(12) United States Patent
Mendenhall

(10) Patent No.: US 10,959,581 B2
(45) Date of Patent: Mar. 30, 2021

(54) PAPER PRODUCT DISPENSER

(71) Applicant: James Mendenhall, Bethesda, MD (US)

(72) Inventor: James Mendenhall, Bethesda, MD (US)

( * ) Notice: Subject to any disclaimer, the term of this patent is extended or adjusted under 35 U.S.C. 154(b) by 0 days.

(21) Appl. No.: 16/383,762

(22) Filed: Apr. 15, 2019

(65) Prior Publication Data

US 2020/0323399 A1 Oct. 15, 2020

(51) Int. Cl.

| | |
|---|---|
| ***A47K 10/38*** | (2006.01) |
| ***B05C 5/02*** | (2006.01) |
| *A47K 10/32* | (2006.01) |

(52) U.S. Cl.

CPC ..... *A47K 10/38* (2013.01); *B05C 5/0225* (2013.01); *B05C 5/0245* (2013.01); *A47K 2010/328* (2013.01)

(58) Field of Classification Search

None

See application file for complete search history.

(56) References Cited

U.S. PATENT DOCUMENTS

| | | | | |
|---|---|---|---|---|
| 3,495,571 | A | 2/1970 | Evans | |
| 3,540,631 | A | 11/1970 | Schmidt | |
| 3,583,228 | A * | 6/1971 | Tobiassen | G01N 1/08 73/863.86 |
| 4,667,846 | A * | 5/1987 | Marceau | A47K 10/32 221/34 |
| 4,984,530 | A | 1/1991 | Dutton | |
| 5,435,465 | A | 7/1995 | El-Amin | |
| 6,457,434 | B1 | 10/2002 | Lazar | |
| 2002/0162848 | A1 | 11/2002 | Na | |
| 2004/0178298 | A1 * | 9/2004 | Kennard | A47K 10/34 242/570 |
| 2006/0150318 | A1 | 7/2006 | Harm | |
| 2013/0334262 | A1 | 12/2013 | Banning et al. | |
| 2015/0150419 | A1 | 6/2015 | Littlehorn, Sr. | |

FOREIGN PATENT DOCUMENTS

| | | | |
|---|---|---|---|
| DE | 3922159 | A1 | 1/1991 |
| DE | 202010017170 | U1 | 2/2011 |
| DE | 102010036072 | A1 | 3/2012 |
| WO | 9008497 | A1 | 8/1990 |
| WO | 9304622 | A1 | 3/1993 |

OTHER PUBLICATIONS

"https://www.homedepot.com/p/Toilet-Paper-Wetting-Dispenser-iwipe-1/205347043", accessed on Apr. 12, 2019, 4 pages.

"http://www.nicowetdry.com/Hybrid-Dispenser-Polished-Chrome-Starter-Pack_p_14.html", accessed on Apr. 12, 2019, 3 pages.

"http://www.iwipe.co.za", accessed on Apr. 12, 2019, 5 pages.

International Search Report and Written Opinion issued in PCT/IB2020/053474, dated Sep. 1, 2020.

* cited by examiner

*Primary Examiner* — Jethro M. Pence

(74) *Attorney, Agent, or Firm* — Hamre, Schumann, Mueller & Larson, P.C.

(57) ABSTRACT

Described and recited herein are example embodiments and implementations of a paper product dispenser by which the paper product may be dampened or moistened as it unrolls, based on at least the angle at which the paper product is unrolled.

14 Claims, 9 Drawing Sheets

PAPER PRODUCT DISPENSER

TECHNICAL FIELD

The embodiments described herein pertain generally to moist paper product dispensers.

BACKGROUND

Demand has steadily grown for moist or damp paper products such as paper towels and toilet tissue (also referred to as "toilet paper") for cleaning and hygiene. To meet such demand, manufacturers have released a series of products such as pre-moistened towelettes and flushable wipes. These products are typically made of a paper product that is thicker than conventional versions because they are intended to be more durable and to remain damp without disintegrating over time. However, such pre-moistened paper products are significantly more expensive than conventional paper towels or toilet tissue and are environmentally "unfriendly." For instance, the pre-moistened products do not decompose as easily as the conventional products, thus resulting in clogs in local drains and sludge build-up in sewage reservoirs. The pre-moistened products are typically sold in plastic packaging that is also environmentally "unfriendly," cumbersome to use, and allows the paper to dry out over time.

SUMMARY

One example embodiment of the paper product dispenser includes a paper product holder by which a dry paper product may be unrolled towards a front end thereof and a fluid-dispensing tank placed above the paper product dispensing roller. The fluid-dispensing tank includes a fluid-dispensing hole on a bottom portion of the tank and beyond the front end of the paper product roller, a stopper to open and close the fluid-dispensing hole to regulate dispensing of fluid from the fluid-dispensing tank, and a lever configured to control the stopper to open the fluid-dispensing opening.

BRIEF DESCRIPTION OF THE DRAWINGS

In the detailed description that follows, embodiments are described as illustrations only, as various changes and modifications will become apparent to those skilled in the art from the following detailed description. The use of the same reference numbers in different figures indicates similar or identical items.

DETAILED DESCRIPTION

Figure 1A:
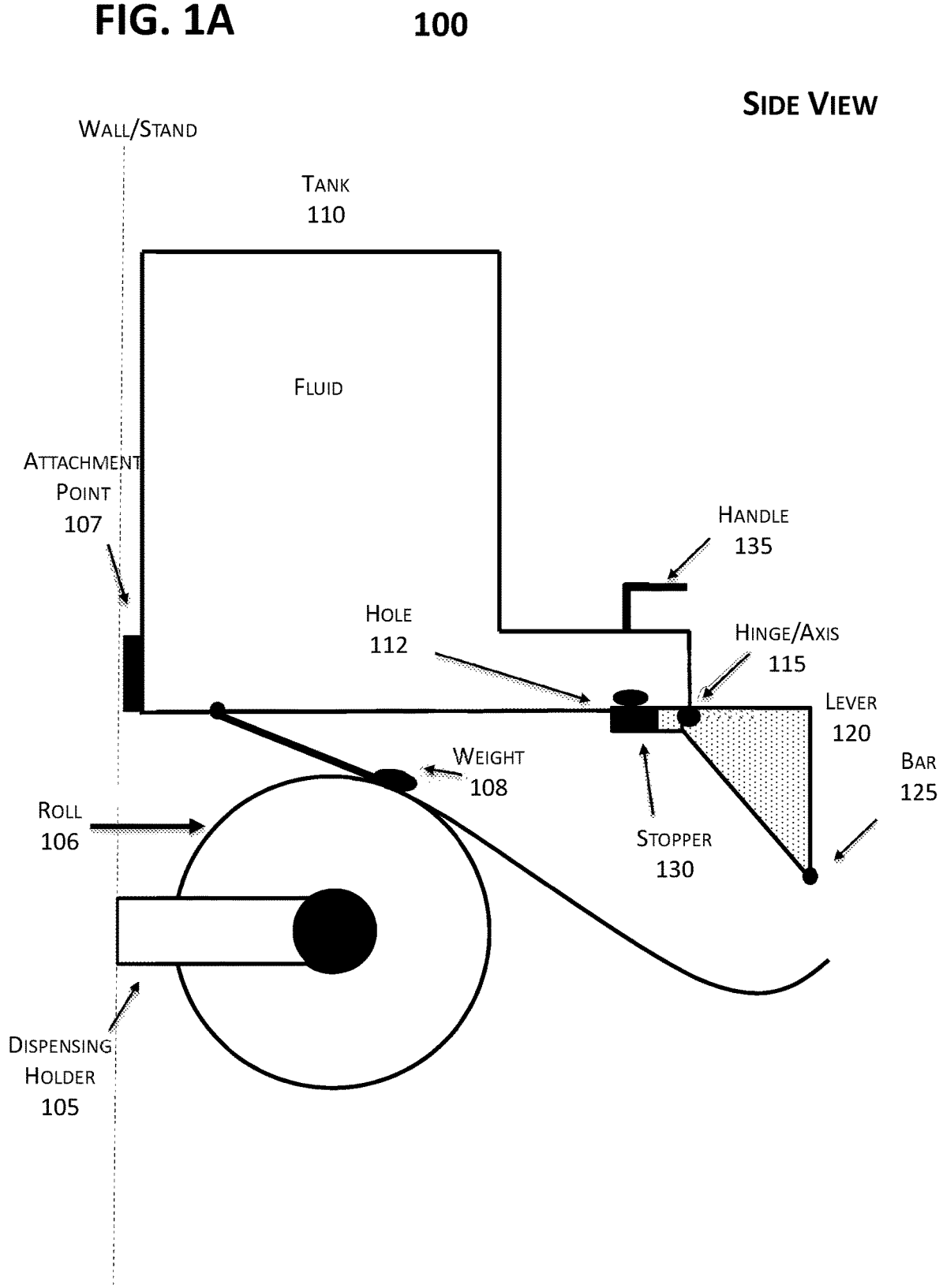
FIG. 1A shows a side view of an example paper product dispenser, in accordance with the embodiments described herein.

In the following detailed description, reference is made to the accompanying drawings, which form a part of the description. In the drawings, similar symbols typically identify similar components, unless context dictates otherwise. Furthermore, unless otherwise noted, the description of each successive drawing may reference features from one or more of the previous drawings to provide clearer context and a more substantive explanation of the current example embodiment. Still, the example embodiments described in the detailed description, drawings, and claims are not intended to be limiting. Other embodiments may be utilized, and other changes may be made, without departing from the spirit or scope of the subject matter presented herein. It will be readily understood that the aspects of the present disclosure, as generally described herein and illustrated in the drawings, may be arranged, substituted, combined, separated, and designed in a wide variety of different configurations, all of which are explicitly contemplated herein.

Described and recited herein is a paper product dispenser that is compatible with existing rolled paper products such as, but not exclusive to, paper towels and toilet tissue, i.e., toilet paper. Thus, as referenced herein "paper products" may refer to loosely woven, pliable paper products that are typically rolled about a cardboard tube, configured in a series of perforated sheets. Paper products, as referenced herein, are disposable and intended for one-time use.

Further, because the paper product dispenser described and recited herein is compatible with existing rolled paper products that are designed to decompose quickly and efficiently, there is no adverse effect on local plumbing or sewage infrastructure; and there is no out-of-the-ordinary effect on the environment since there is no need to reconfigure the packaging of the paper products.

Further still, the paper product dispenser described and recited herein provides a user with an option to unroll and use the paper product as it was packaged, i.e., dry, or to utilize the paper product dispenser to dampen or moisten the dry paper product as it is unrolled. In the latter scenario, the paper product may be moistened to an extent preferred by the user. For example, unrolling the paper product at a slower rate results in the paper product being dampened or moistened to a greater extent than if the paper product were unrolled at a comparatively faster rate. Thus, the paper product dispenser facilitates personalized cleaning and/or hygienic care. Further still, when the paper product on roll 106 is not pre-moistened, there is no concern that the paper product will dry out in its packaging. That is, it is dampened or moistened on demand.

FIG. 1A shows a side view of example paper product dispenser 100, in accordance with the embodiments described herein. As depicted, paper product dispenser 100 includes at least dispensing holder 105, attachment point 107, weighted rod 108, tank 110, hole 112, hinge/axis 115, lever 120, bar 125, stopper 130, and handle 135.

Dispensing holder 105 may refer to a roll or spindle for a paper towel holder or toilet paper holder. Commonly known paper towel and toilet paper holders include a spindle that is inserted into a paper product roll 106; and the spindle is then attached to parallel arms of a holder that is attached to a stand or wall using a bracket. The spindle is at least substantially parallel to the ground so that paper product roll 106 may be unrolled in an upward or downward direction.

Alternative embodiments of dispensing holder 105 that are compatible with embodiments of the paper product dispenser described and recited herein include free-standing holders that may or may not have parallel arms, but rather an open-ended spindle onto which paper product roll 106 is inserted or a holder that is attached to a free-standing tower rather than attached to a wall.

Attachment point 107 may refer to a bracket by which dispensing holder 105 and/or tank 110 are stabilized. Attachment point 107 may be implemented as a bracket, adhesive material or plural adhesive pads, or any other mechanical means by which dispensing holder 105 and/or tank 110 are made stationary relative to one another. Thus, attachment point 107 may affix dispensing holder 105 and/or tank 110 to a wall, free-standing tower (at user height), etc., so long as a relative position between dispensing holder 105 and tank 110 is stabilized.

Weight 108 may refer to a weight provided to apply tension on top of paper product roll 106 as the paper product is unrolled from dispensing holder 105. Accordingly, weight 108 may be provided in terms of ounces, to thereby provide tension that is sufficient to ensure that the paper product is unrolled from paper product roll 106 in a taut manner but without inhibiting the unrolling of the paper product, e.g., causing the paper product to tear in any direction.

Weight 108 may be affixed to a distal end of a rigid rod that extends from a bottom portion of tank 110 to a top of any paper product roll 106 on dispensing holder 105. In at least some embodiments, the rigid rod may be attached to the bottom portion of tank 110 by a hinge or other known axial means of attachment to enable the rod to descend as the amount of paper product on paper product roll 106 decreases. Alternatively, weight 108 may be tied to an end of a string or elastic band tied to or affixed to a bottom portion of tank 110, so long as weight 108 sits atop paper product roll 106 on dispensing holder 105 as the amount of paper product on paper product roll 106 decreases. Even further, weight 108 may alternatively be attached to dispensing holder 105, again, so long as weight 108 sits atop paper product roll 106 on dispensing holder 105.

Tank 110 may refer to a re-fillable receptable that is above dispensing holder 105 such that fluid-dispending hole 112 on the bottom of the receptacle is located beyond a front end of the spindle of dispensing holder 105 at a distance that exceeds a radius of paper product roll 106 when the roll is full. Tank 110 may have a removeable lid that may be removed so that the tank may be re-filled with fluid. The lid may also cover the open top and sides of the tank to form essentially an open box that would be inverted to cover the tank, and may, when removed from the tank, serve a second function as a pitcher to refill the water in the tank. In addition to, or in the alternative, tank 110 may have a top and/or side opening through which the tank may be re-filled with fluid.

Tank 110 may be configured to hold and dispense water, cleaning fluid, hygienic rinse, etc., or any other fluid that may be appropriate for dampening or moistening paper towels or toilet tissue as the paper product is unrolled. Accordingly, a fluid held in tank 110 would be sufficiently liquid to pour through hole 112 in a stream and/or a drip.

Further, embodiments of tank 110 may vary in accordance with the strength of attachment point 107. That is, the volume of fluid capable of being stored in tank 110 may depend upon the holding strength of attachment point 107, so that tank 110 does not collapse under the weight of the fluid therein. Accordingly, whatever fluid is held in tank 110 is to be provided in a volume that does not stress the structural integrity of the paper product dispenser described and recited herein.

As referenced above, hole 112 may refer to an opening at the bottom of the receptacle that is located beyond the front of the spindle of dispensing holder 105 at a distance that exceeds a radius of paper product roll 106 when the roll is full. Thus, hole 112 may be located on a bottom of a portion of tank 110, which may be provided in a block configuration; alternatively, hole 112 may be located on a bottom portion of an extension of tank 110, which may be provided in an "L" configuration as shown in FIG. 1A; or, as a further alternative, hole 112 may be located on a bottom portion of a separate receptacle that is inserted into tank 110 and extends outward, with hole 112 being located on a bottom of the portion that extends out of tank 110. A pipe may serve as an example embodiment of such a receptacle. All of the aforementioned are contemplated as viable configurations of a paper product dispenser as described and recited herein, and the descriptions and recitations are not limited to any one configuration.

Hole 112 may be configured as an opening of any geometric configuration that facilitates the dispensing of a fluid from tank 110 in a controlled manner. That is, hole 112 may be configured to allow fluid to be released from tank 110 in, e.g., drips or as a regulatable stream. For example, when hole 112 is configured as a circular opening and stopper 130 is removed from the bottom of tank 110 to expose hole 112, the rate at which fluid is released onto the paper product may depend on at least one of a size of hole 112 and viscosity of the fluid. In at least some alternative embodiments, hole 112 may be an elongated opening that spans substantially the width of the paper product on roll 106 and stopper 130 is configured similarly to act as a plug. Thus, when stopper 130 is removed from the bottom of tank 110 to expose hole 112, the fluid is likely to be released onto the paper product in a stream until stopper 130 once again presses against the bottom of tank 110, as described further below.

Further still, in accordance with various embodiments of a paper product dispenser as described and recited herein, dispensing holder 105 may be either separate from or physically integrated with tank 110. Regardless, together, dispensing holder 105 and tank 110 together provide the structural framework for the paper product dispenser described and recited herein.

Hinge/axis 115 may be affixed substantially close to a distal end of tank 110 or the receptacle extending outward therefrom, extending beyond hole 112 over a front of the spindle of dispensing holder 105, at a distance that exceeds a radius of paper product roll 106 when the roll is full, even more so relative to hole 112. Hinge/axis 115 and, therefore, lever 120, may turn upwards, but not downwards, from its resting position because stopper 130, which is attached to an inner portion of lever 120 is positioned across a bottom portion of tank 110 or the receptacle extending outward therefrom and therefore prevents hinge/axis 115 from rotating lever 120 downward. Various embodiments of the paper product dispenser described and recited herein may include a spring as part of hinge/axis 115, although such embodiments are not exclusive.

Lever 120 may refer to an elongated appendage that is attached to tank 110, via hinge/axis 115. At a resting position, an inner portion of lever 120 sits along a bottom portion of tank 110; and an outer portion of lever 120 extends over a front end of the spindle of dispensing holder 105 and beyond a distance that exceeds a radius of paper product roll 106 when the roll is full. The inner portion of lever 120 and the outer portion of lever 120 are described and recited herein relative to hinge/axis 115.

Thus, the inner portion of lever 120 has stopper 130 attached thereto. According to one example configuration, the inner portion of lever 120 has parallel extensions to which stopper 130 may be attached. According to another example configuration, stopper 130 may be attached to a top surface of the inner portion of lever 120. By either example configuration, the return force of hinge/axis 115 presses or pushes a top surface of stopper 130 against hole 112 so that stopper 130 effectively seals hole 112 when lever 120 is in its resting position.

When lever 120 is in its resting position, the outer portion of lever 120 is parallel to a bottom of tank 110 and with a substantially downward extension at its furthest end. Various embodiments of the outer portion of lever 120 may extend downwards at an angle that is less than 90-degrees though away from roll 106.

Bar 125 may refer to a smooth and rigid edge to a bottom of the substantially downward extension of the furthest end of lever 120. Bar 125 may be of any length, though it may be impractical to exceed the width of roll 106. Regardless of length, in accordance with at least some embodiments of a paper product dispenser, bar 125 may serve as a point or surface of contact with the paper product other than that of the user or whatever other means may be utilized to unroll the paper product from roll 106. Accordingly, a surface of bar 125 is sufficiently smooth to avoid prohibiting the paper product from being unrolled from roll 106 or to avoid inadvertently tearing the paper product as it is unrolled.

Bar 125 is also to be sufficiently rigid in order to bias lever 120 upwards under the force of the paper product being unrolled from roll 106 in an upward direction at various rates of unrolling. As described in detail further below, as the paper product is unrolled in an upward direction, lever 120 is lifted, thus pulling the inner portion of lever 120 away from tank 110 via hinge/axis 115 and, therefore, removing stopper 130 from hole 112; as a result, at least portions of hole 112 are opened, resulting in at least a stream of fluid pouring from tank 110 onto the paper product being unrolled from roll 106.

Stopper 130 may refer to one of plural mechanical means for sealing and opening hole 112, in accordance with various embodiments of the paper product dispenser described and recited herein. Stopper 130 may be attached to the inner portion of lever 120, e.g., between parallel arms or attached to a top surface thereof, and covers fluid-dispensing hole 112 when lever 120 is in a resting position. However, as described above, as the paper product is unrolled from roll 106 in an upward direction, lever 120 is also lifted, thus pulling the inner portion of lever 120 away from tank 110 via hinge/axis 115 and, therefore, removing stopper 130 from hole 112. As a result, at least portions of hole 112 are opened, resulting in at least a stream of fluid pouring from tank 110 onto the paper product being unrolled.

Stopper 130 may be configured in a variety of manners, so long as it serves to plug hole 112 when lever 120 is in its resting position and to release fluid from tank 110 when lever 120 is lifted thus pulling the inner portion of lever 120 away from tank 110. Thus, stopper 130 may be configured in a variety of shapes having a flat or malleable top layer that may effectively seal hole 112.

In accordance with at least some embodiments having varying configurations of stopper 130, the degree to which the paper product is unrolled from roll 106 in an upward direction may influence the degree to which lever 120 is lifted and, therefore, influence the extent to which stopper 130 uncovers portions of hole 112; accordingly, the degree to which the paper product may be unrolled in an upward direction may influence the volume of the stream of fluid that may be poured onto the paper product as it is unrolled.

Handle 135 may refer to another one of plural mechanical means for sealing and opening hole 112, in accordance with various embodiments of the paper product dispenser described and recited herein. Handle 135 may be implemented as an elongated bar, possibly plastic or metal, of which an upper end may extend from outside of tank 110, substantially perpendicular to the plane of hole 112, downward into tank 110. At the bottom inner surface of tank 110, handle 135 may have disk 137 (see FIGS. 2A-2C) attached thereto to cover hole 112. Handle 135 is rotatable, controllable from outside of tank 110, to regulate coverage of hole 112 by disk 137. That is, handle 135 is turned so that disk 137 covers all or portions of hole 112, thereby regulating the volume of the stream of fluid that may pour onto the paper product as it is unrolled from roll 106.

Accordingly, by the non-limiting example configuration of FIG. 1A, dispenser for a rolled paper product may include paper product holder 105, by which a paper product may be unrolled towards a front end of the paper product holder, and fluid-dispensing tank 110 located above paper product dispensing holder 105. Fluid-dispensing tank 110 includes hole 112 located on a bottom portion of tank 110 and beyond the front end of paper product holder 105, stopper 130 to open and close fluid-dispensing hole 112, lever 120 configured to lift when the paper product is unrolled from dispensing holder 105 at an upward angle thereby lowering stopper 130 away from fluid-dispensing opening 112; and disk 137 to regulate the flow of fluid from fluid-dispensing tank 110 through hole 112. Thus, by unrolling the paper product from its roll in an upward manner, the paper product may be dampened or moistened; whereas, by unrolling the paper product from its roll in a downward manner, the paper product remains dry as it avoids contact with the lever.

Figure 1B:
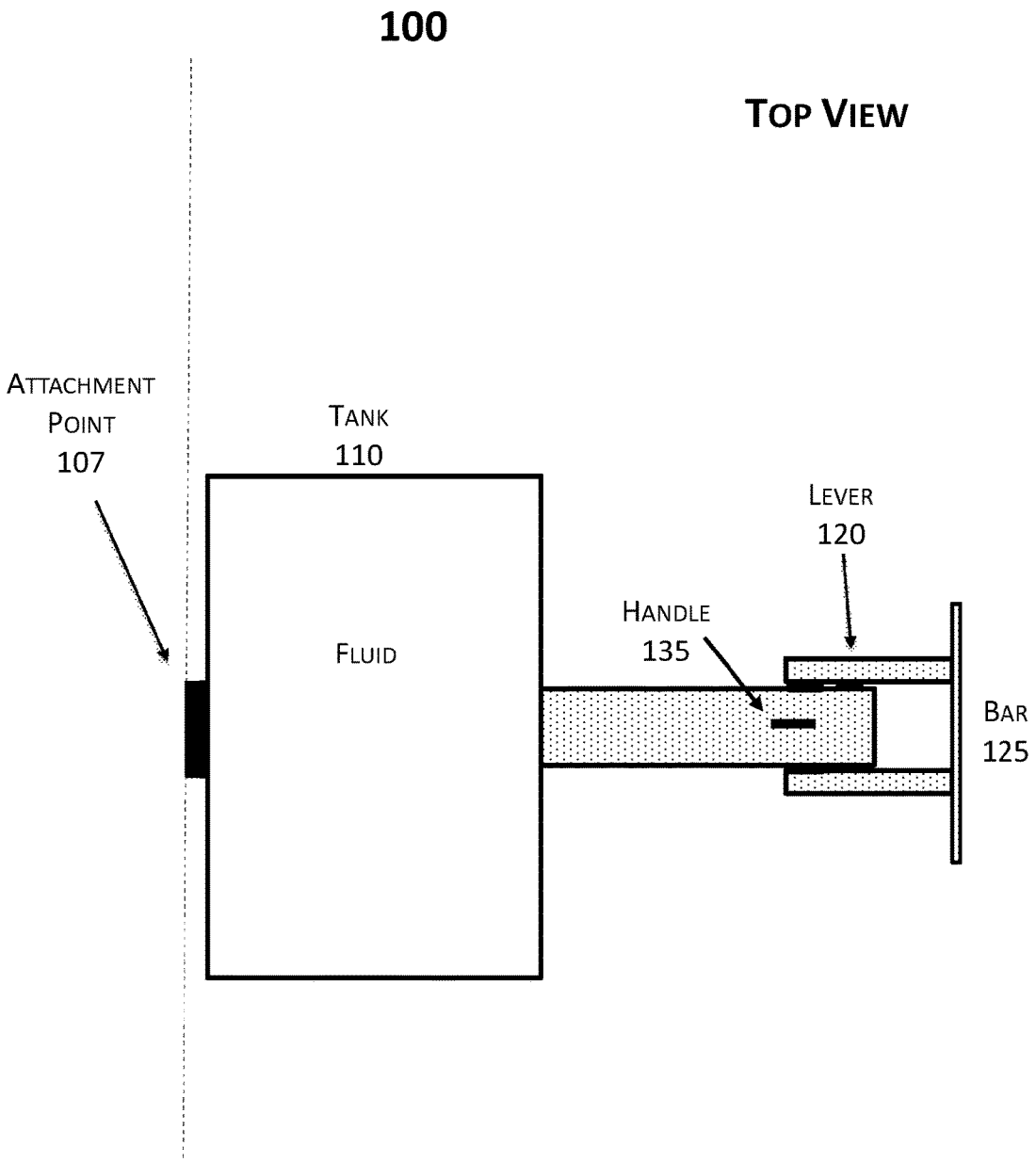
FIG. 1B shows a top view of the example paper product dispenser, in accordance with the embodiments described herein.

FIG. 1B shows a top view of example paper product dispenser 100 of FIG. 1A. As depicted in FIG. 1B, all features of FIG. 1A are present though not all are visible from this view. Thus, the top view of paper product dispenser 100 in FIG. 1B shows attachment point 107, lever 120, bar 125, and handle 135. The functions thereof are unchanged as described and recited herein.

Figure 1C:
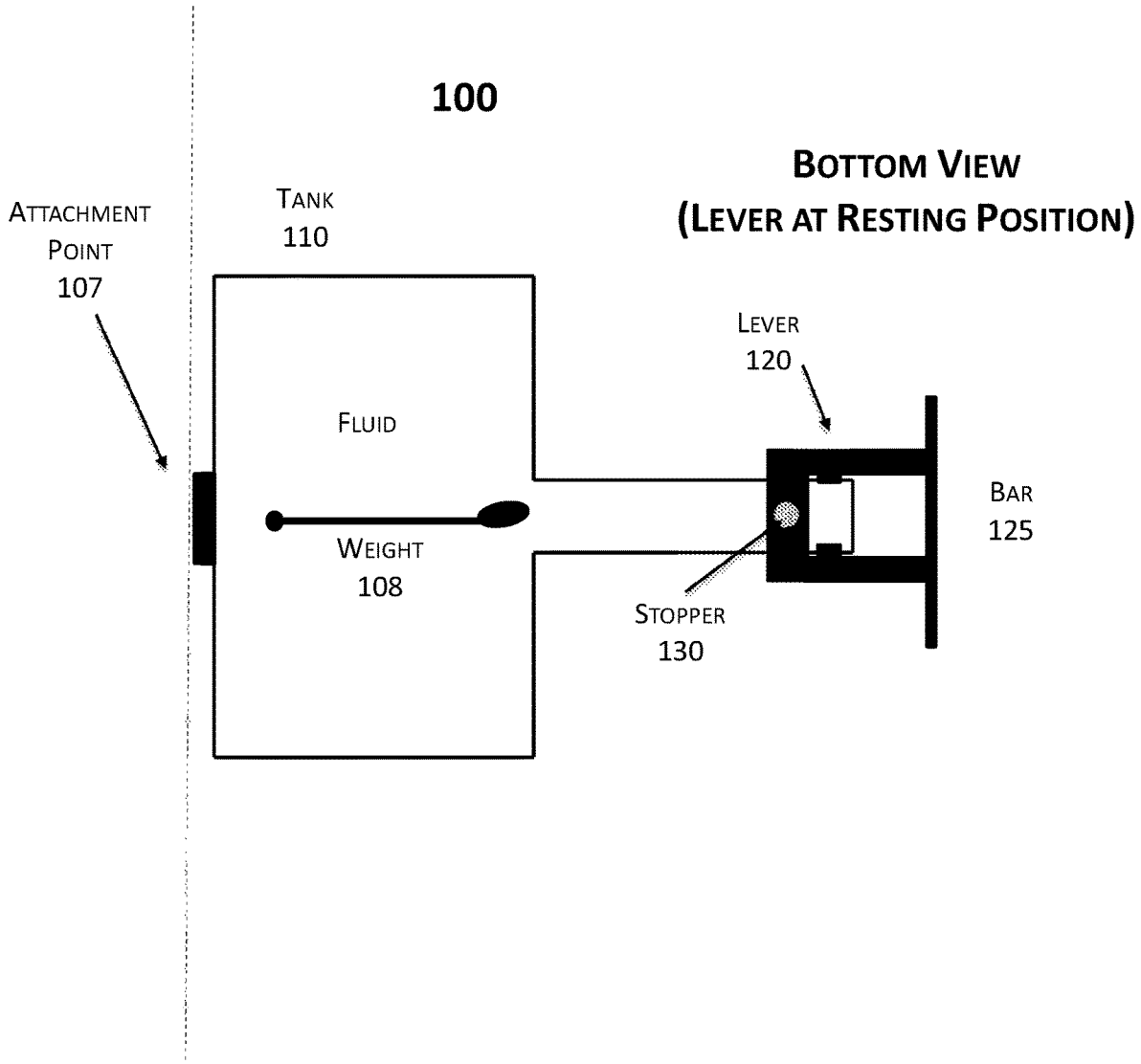
FIG. 1C shows a bottom view of the example paper product dispenser, in accordance with the embodiments described herein.

FIG. 1C shows a variation of a bottom view of example paper product dispenser 100 of FIG. 1A. In the depiction of FIG. 1C, all features of FIG. 1A are present though not all are visible from this view. Thus, the bottom view of paper product dispenser 100 in FIG. 1C shows attachment point 107, tank 110, lever 120, bar 125, and stopper 130. Lever 120 is at rest, i.e., there is no contact with the paper product and bar 125 or, consequently, lever 120. That is, with lever 120 at rest, either no paper product is being unrolled from roll 106 and, therefore, stopper 130 is plugging hole 112 or the paper product is being unrolled in a downward manner so that the paper product remains dry, as lever 120 presses stopper 130 to thereby plug hole 112.

Figure 1D:
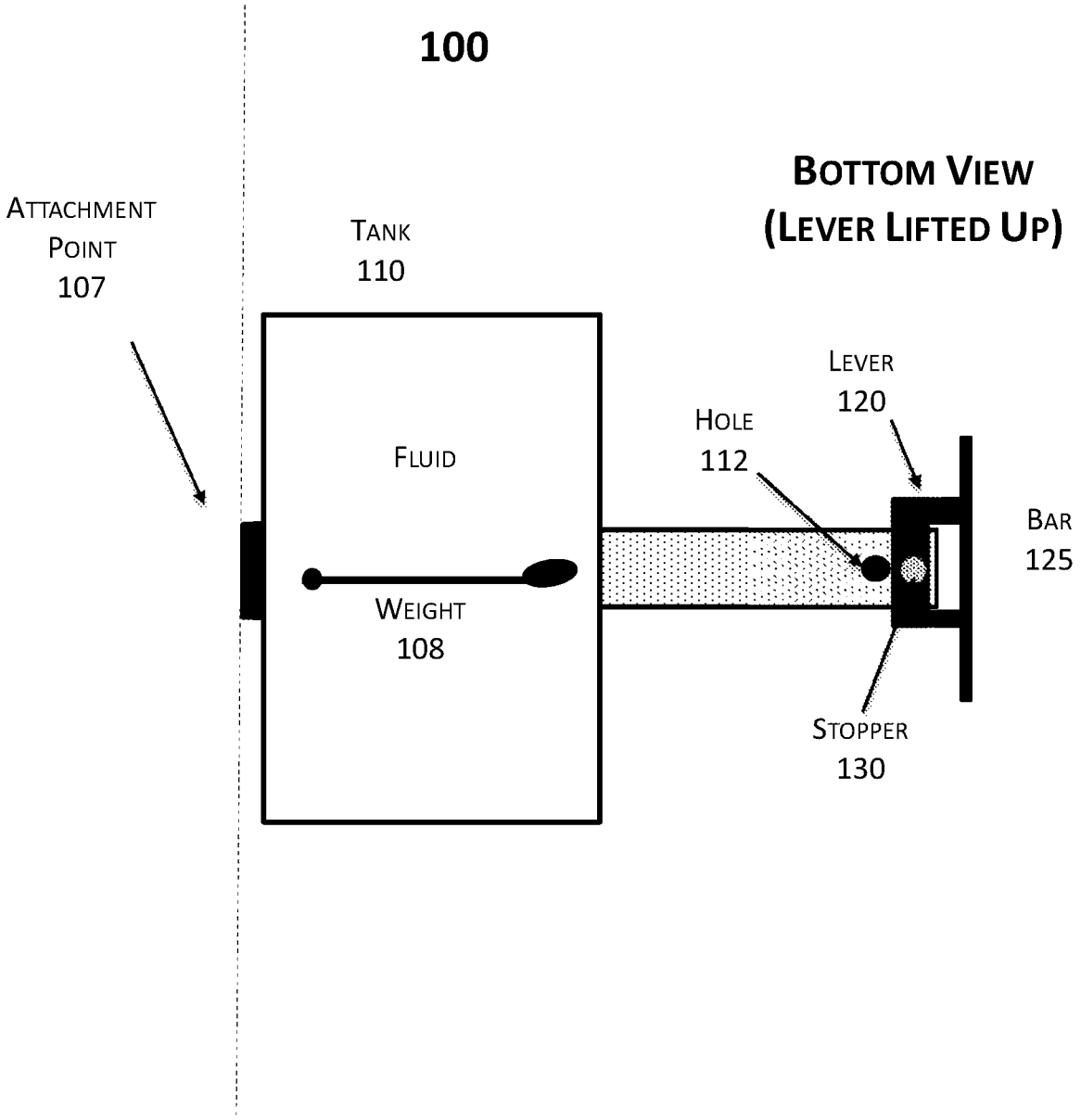
FIG. 1D also shows a bottom view of the example paper product dispenser, in accordance with the embodiments described herein.

FIG. 1D shows a variation of a bottom view of example paper product dispenser 100 of FIG. 1A. In the depiction of FIG. 1D, all features of FIG. 1A are present though not all are visible from this view. Thus, the bottom view of paper product dispenser 100 in FIG. 1C shows attachment point 107, weight 108, tank 110, lever 120, bar 125, and stopper 130. Lever 120 is in a raised position, i.e., there is contact between the paper product and bar 125 or, consequently, lever 120, as the paper product is unrolled at an upward angle relative to roll 106. That is, the paper product contacting bar 125 and raising lever 120 to some extent, pulls stopper 130 away from hole 112; and fluid is released from tank 110 onto the paper product that is being unrolled. As a result, the unrolled paper product is dampened or moistened to an extent corresponding to the user's preference implemented by at least one of the angles at which the paper product is unrolled from roll 106 and the rate at which the paper product is unrolled from roll 106.

Figure 2A:
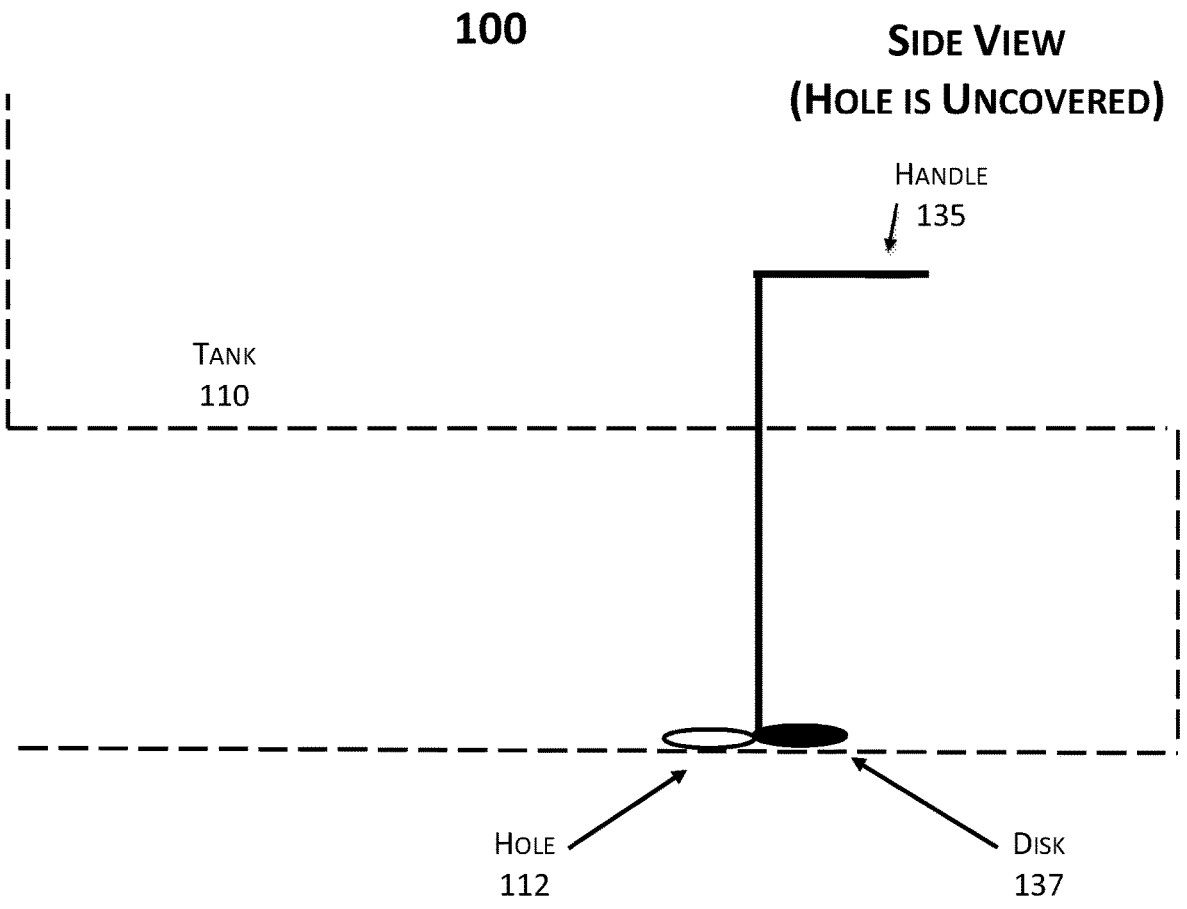
FIG. 2A shows a partial side view of an interior of the example paper product dispenser, in accordance with the embodiments described herein.

FIG. 2A shows a variation of an internal side view of example paper product dispenser 100 of FIG. 1A. In the depiction of FIG. 2A, all features of FIG. 1A are present though not all are visible from this view from within tank 110 or, according to some alternative embodiments, a receptacle that is inserted into tank 110. Thus, the view of paper product dispenser 100 in FIG. 2A shows tank 110, hole 112, handle 135, and disk 137. As set forth above, handle 135 may be implemented as an elongated bar, possibly plastic or metal, of which an upper end may extend from outside of tank 110, substantially perpendicular to the plane of hole 112, downward into tank 110. FIG. 2A shows tank 110 having hole 112 located on a bottom portion of tank 110 beyond the front end of paper product holder 105. Handle 135 may have disk 137 attached at a bottom portion thereof, inside of tank 110, to variably cover hole 112 to thereby regulate a flow of fluid as it is released from tank 110. That is, as handle 135 is rotated by a user or by mechanical means from outside of tank 110, coverage of hole 112 by disk 137 may be changed. That is, handle 135 may be rotated so that disk 137 covers all or portions of hole 112, thereby regulating the volume of the stream of fluid that may be released from tank 110 onto the paper product as it is unrolled from roll 106. FIG. 2A shows hole 112 left completely uncovered by disk 137 because handle 135 has been rotated a full 180-degrees from the position at which hole 112 is fully covered.

Figure 2B:
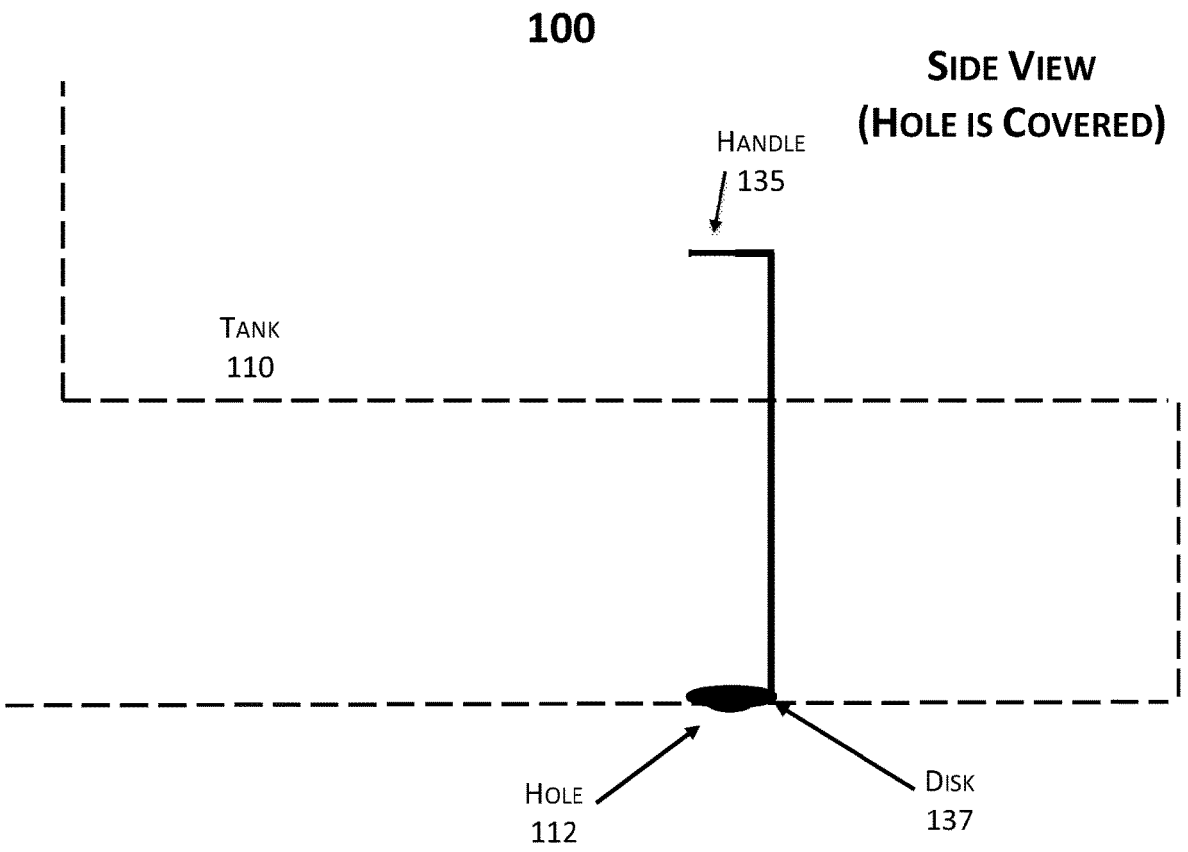
FIG. 2B also shows a partial side view of an interior of the example paper product dispenser, in accordance with the embodiments described herein.

FIG. 2B shows a variation of the view of example paper product dispenser 100 of FIG. 2A. In the depiction of FIG. 2B, all features of FIG. 2A are present, although hole 112 is uncovered by disk 137 because handle 135 has not been rotated a full 180-degrees, from the position at which hole 112 is fully covered.

Figure 2C:
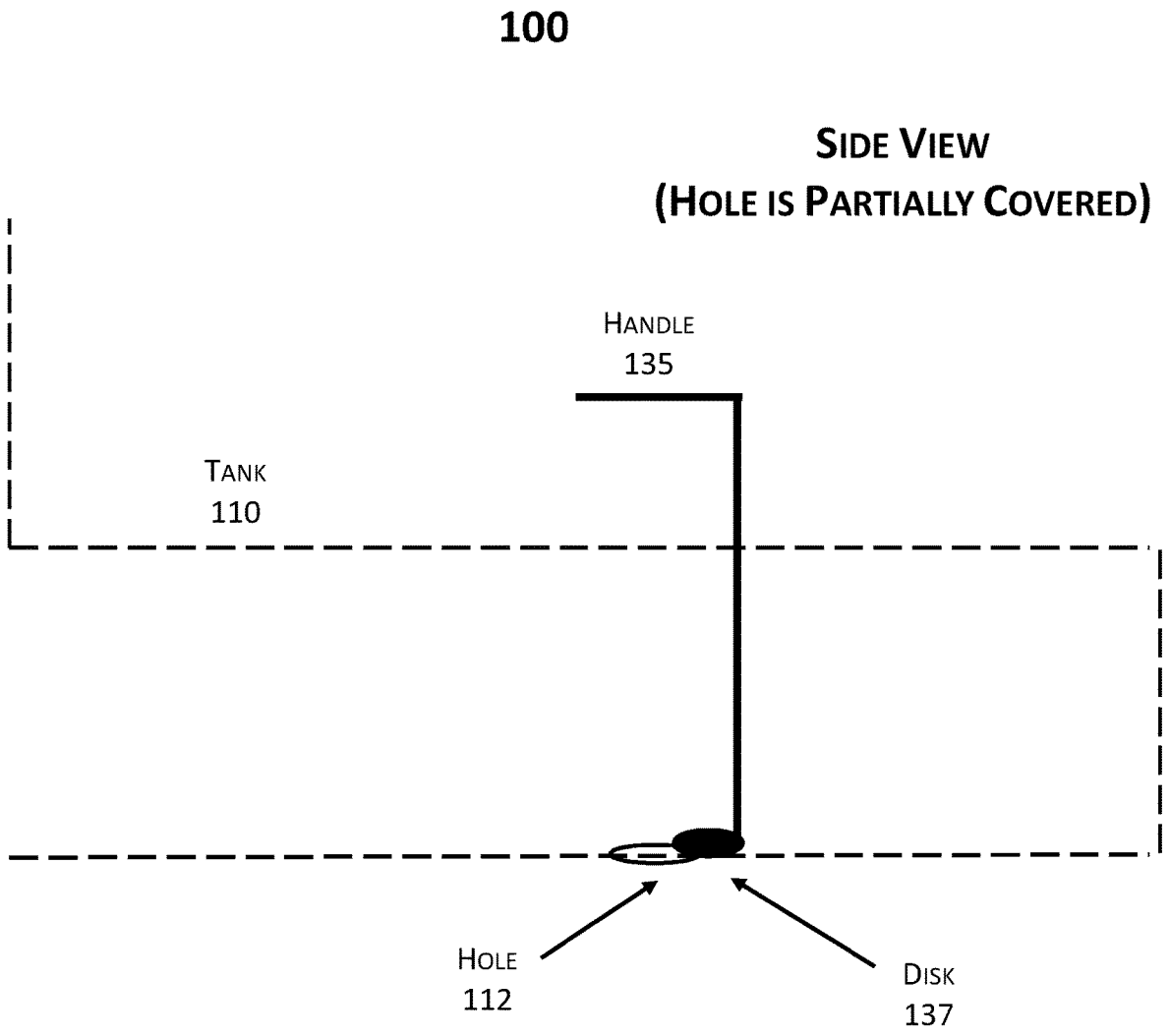
FIG. 2C shows yet another partial side view of an interior of the example paper product dispenser, in accordance with the embodiments described herein.

FIG. 2C shows yet another variation of the side view of example paper product dispenser 100 of FIG. 2A. In the depiction of FIG. 2B, all features of FIG. 2A are present, and handle 135 is at the position at which hole 112 is partially covered by disk 137.

Figure 3A:
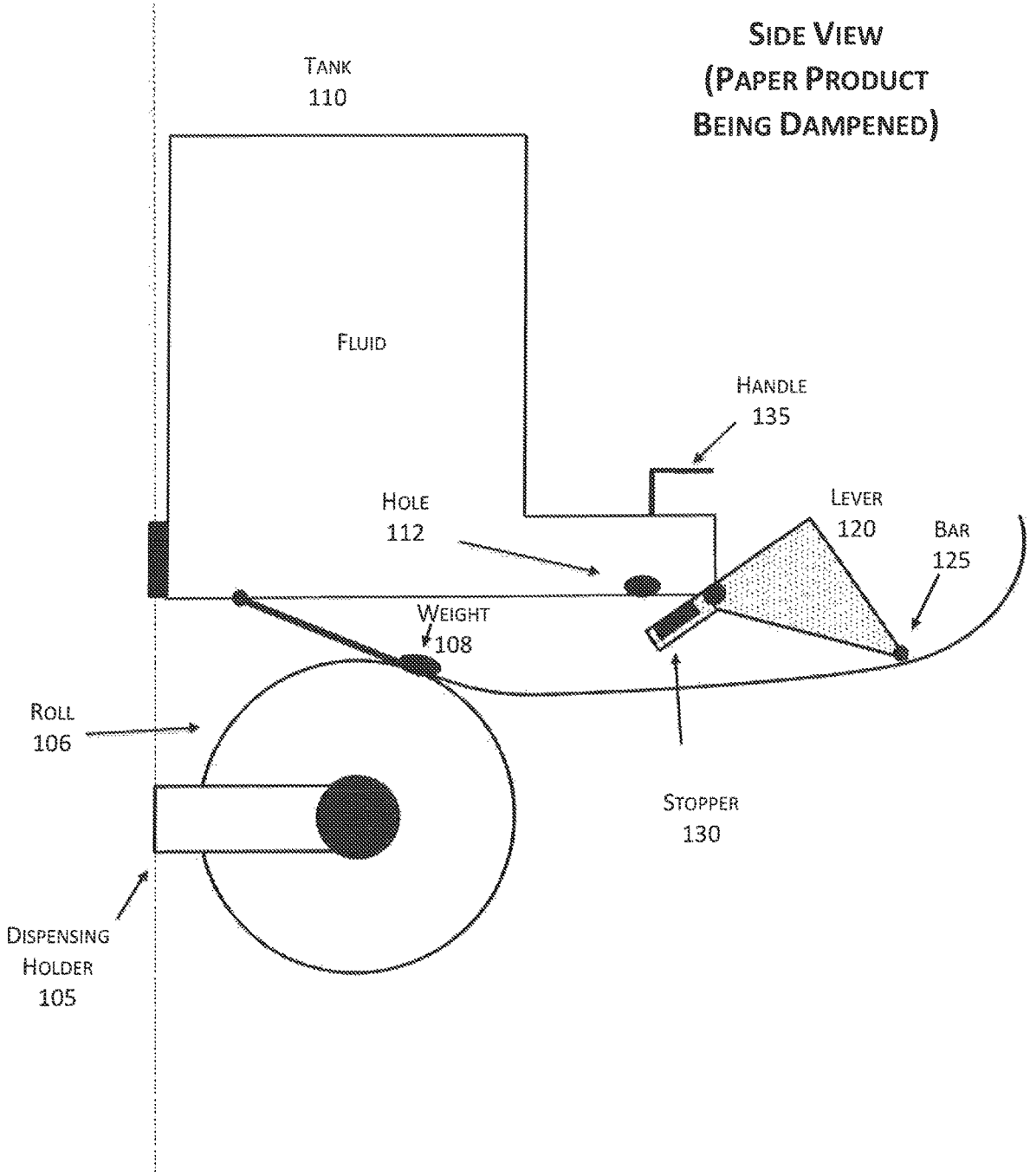
FIG. 3A shows a side view of the example paper product dispenser in use, in accordance with at least one implementation described herein.

FIG. 3A shows a side view of the example paper product dispenser in use, in accordance with at least one implementation described herein. FIG. 3A shows a side view of example paper product dispenser 100 of FIG. 1A.

In accordance with the example embodiments and implementations described and recited herein, a user may lift lever 120 by unrolling a paper product from roll 106 to release fluid from tank 110 via hole 112.

The opening of hole 112 may be adjusted by rotating handle 135, and consequently disk 137; but embodiments of hole 112 may also have varying dimensions, i.e., different shapes and/or sizes, to change the volume of fluid that is released onto the unrolled paper, so that the volume of fluid that is released does not result in the paper product dissolving or clumping. The fluid released from tank 110 may typically be released only down the center of the paper product as it is unrolled, so that the sides of the paper retain sufficient strength and integrity not to tear.

In addition, or alternatively, the user may modulate the flow of fluid from tank 110 onto the paper product being unrolled from roll 106 by unrolling the paper at a faster rate (reducing dampness) or slower rate (increasing dampness). A surface of bar 125 is to be sufficiently smooth to avoid prohibiting the paper product from being unrolled or to avoid inadvertent tearing of the paper product as it is unrolled.

Weight 108 is provided to maintain tension of the paper product as it is unrolled from roll 106, making it easier for lever 120 to be lifted. Weight 108 may be hinged so that it lowers as the roll is unrolled.

Figure 3B:
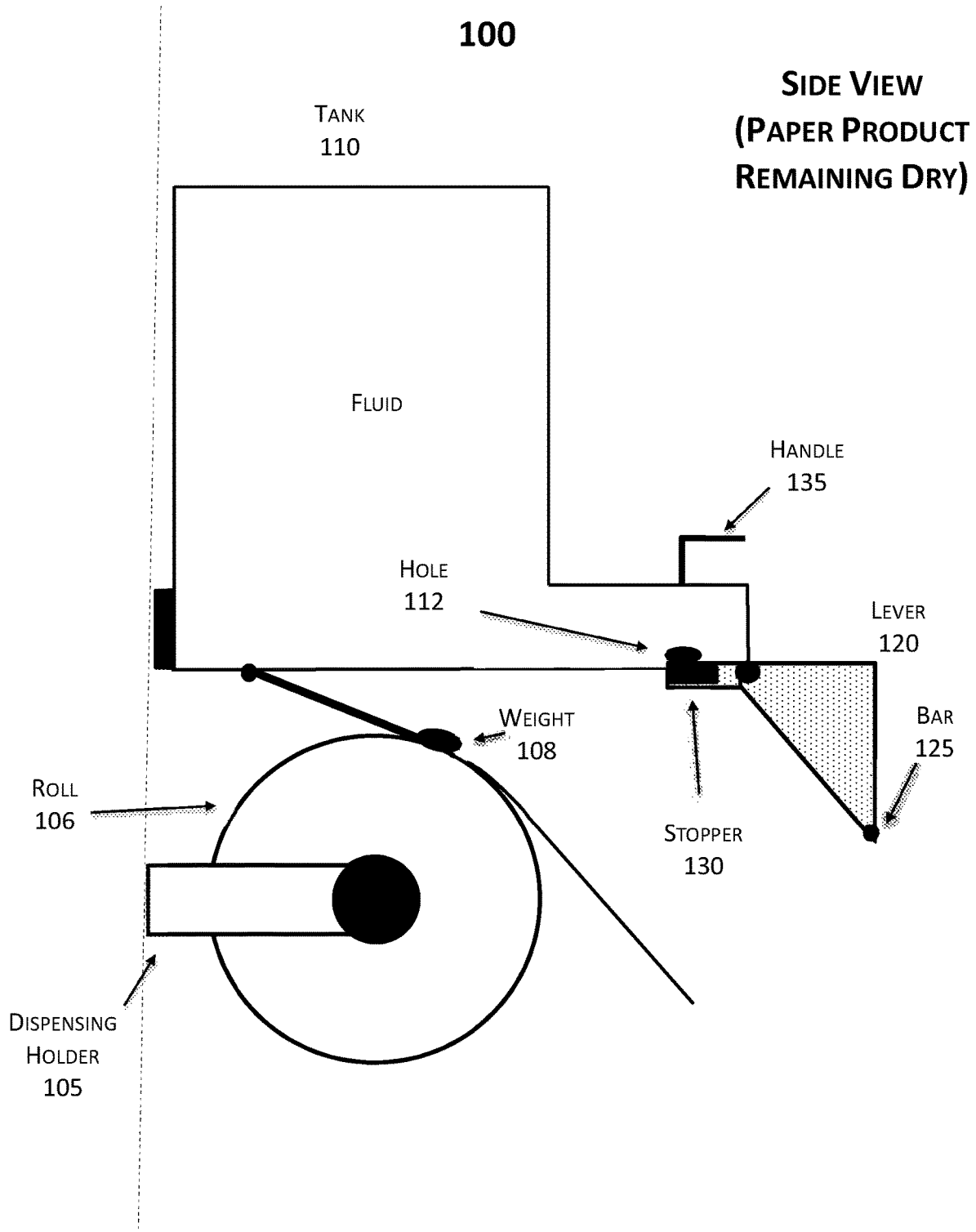
FIG. 3B shows a side view of the example paper product dispenser in use, in accordance with at least one other implementation described herein.

FIG. 3B shows a side view of the example paper product dispenser in use, in accordance with at least one other implementation described herein. FIG. 3B shows a side view of example paper product dispenser 100 of FIG. 1A and, therefore, FIG. 3A.

As shown in FIG. 3B, the user may unroll the paper product from roll 106 at such an angle that the paper product being unrolled makes no contact with bar 125 and, therefore, the paper product remains dry.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

I claim:

1. A dispenser for a rolled paper product, comprising:

a paper product holder, with a paper product being unrolled towards a front end of the paper product holder;

a fluid-dispensing tank above the paper product holder, the fluid-dispensing tank including:

a fluid-dispensing hole located on a bottom portion of the fluid-dispensing tank and beyond the front end of the paper product holder, a stopper configured to open and close the fluid-dispensing hole to regulate dispensing of fluid from the fluid-dispensing tank onto the paper product that is being unrolled, and a lever configured to control the stopper by being movable as forced in an upwards manner to open the fluid-dispensing hole by the paper product being unrolled and contacting a front portion of the lever.

2. The dispenser of claim 1, wherein the paper product holder and the fluid-dispensing tank are attached to a common bracket.

3. The dispenser of claim 2, wherein the paper product holder includes spindle that is inserted into a roll of a paper product.

4. The dispenser of claim 3, wherein the fluid-dispensing hole is located beyond the front of the spindle of the paper product holder at a distance that exceeds a radius of a full roll of the paper product.

5. The dispenser of claim 1, wherein the lever is lifted upwards as the paper product is unrolled upwards and contacts a front portion of the lever.

6. The dispenser of claim 5, wherein the lever being lifted upwards acts to pull away the stopper to open at least a portion of the fluid-dispensing hole.

7. The dispenser of claim 6, wherein the lever and the stopper are attached via a hinge.

8. The dispenser of claim 7, wherein the lever turns on the hinge to pull away the stopper to uncover at least a portion of the fluid-dispensing hole and to return the stopper to cover the fluid-dispensing hole.

9. The dispenser of claim 1, wherein the rolled paper product is a roll of paper towels.

10. The dispenser of claim 1, wherein the rolled paper product is a roll of toilet tissue.

11. The dispenser of claim 1, wherein the fluid-dispensing tank is filled with water.

12. The dispenser of claim 1, wherein the stopper opens to dispense the fluid in a controlled stream.

13. The dispenser of claim 1, wherein the stopper opens to dispense the fluid as a stream.

14. The dispenser of claim 1, further comprising a rotatable disk, disposed inside the fluid-dispensing tank, the rotatable disk being rotatable from a handle external to the fluid-dispensing tank so as to variably cover the fluid dispensing hole.

* * * * *